US005351883A

United States Patent [19]

Pachl

[11] Patent Number: 5,351,883

[45] Date of Patent: Oct. 4, 1994

[54] SECURITY MAILBOX

[76] Inventor: John Pachl, 10021 N.E. 152nd Ave., Vancouver, Wash. 98682

[21] Appl. No.: 26,972

[22] Filed: Mar. 5, 1993

[51] Int. Cl.[5] ..... B65D 91/00; B65G 11/04

[52] U.S. Cl. ..... 232/17; 232/24; 232/39; 232/45; 248/679

[58] Field of Search ..... 232/17, 44, 45, 24, 232/39; 248/679; 109/66; D99/29

[56] References Cited

U.S. PATENT DOCUMENTS

| | | | |
|---|---|---|---|
| 1,227,934 | 5/1917 | Riegg | 232/17 |
| 1,664,462 | 4/1928 | Muehleisen | 232/24 |
| 2,963,168 | 12/1960 | Wilson | 232/17 |
| 3,070,234 | 12/1962 | Deitchman | 232/17 |
| 3,880,344 | 4/1975 | Earle | 232/17 |
| 4,121,758 | 10/1978 | Bonner | 232/17 |
| 4,600,143 | 7/1986 | Harlow, Jr. et al. | 232/17 |
| 4,724,999 | 2/1988 | Fitzgerald et al. | 232/17 |
| 4,844,332 | 7/1989 | Long | 232/17 |
| 4,905,891 | 3/1990 | Wildish et al. | 232/17 |
| 4,934,592 | 6/1990 | DiMehichi | 232/17 |
| 4,993,626 | 2/1991 | Berry | 232/17 |
| 5,000,378 | 3/1991 | Dorr et al. | 232/17 |
| 5,056,711 | 10/1991 | Bush | 232/17 |
| 5,071,063 | 12/1991 | Overstreet | 232/17 |
| 5,096,115 | 3/1992 | Hassan | 232/17 |
| 5,143,284 | 9/1992 | Socarras | 232/24 |
| 5,148,974 | 9/1992 | Clapper | 232/17 |

*Primary Examiner*—Michael Milano
*Attorney, Agent, or Firm*—Marger Johnson McCollom & Stolowitz

[57] ABSTRACT

The invention comprises a mail access section sufficiently dimensioned for receiving and supporting letters and packages for pickup and delivery by a mail carrier. A mail containment section supports the access section above the ground and receives the mail which is inserted through the access section. The combined length of the access section and containment section are selected so that someone cannot reach through the access section down into the mail containment section. However, the access section is appropriately dimensioned so that mail can be easily placed or tossed into the containment portion. In a alternative embodiment of the invention, a slidable table is located within the access section to provide additional storage space for outgoing packages allowing the structure to operate as a normal, non-security mailbox. In addition, a multi-user security mailbox is described that can be used for multiple residences.

18 Claims, 3 Drawing Sheets

SECURITY MAILBOX

BACKGROUND OF THE INVENTION

This invention relates generally to security mailboxes that prevent unauthorized access to mail placed therein and more particularly to an inexpensive mailbox structure that uses the same access section for both depositing and storing mail and the same containment section for both supporting the access structure and storing mail.

There are many security mailboxes that prevent unauthorized access to stored mail. Security mailboxes must be designed so that a thief cannot simply reach into the box and remove the contents. For example, mailboxes in apartment complexes prevent unauthorized removal of mail by providing a locking front access door. However, these mailboxes also require a mailman to first unlock the door and then relock the door after the mail has been inserted. This type of system is time consuming and, therefore, is not efficient for single family residences where only one or two mailboxes are ever located next to each other. As a result, mail carriers will not carry separate keys for single family lockable mailboxes. In addition, if a single "pass key" were used for every mailbox, the security of all mailboxes would be compromised if anyone obtained access to that key.

In addition to being time consuming for mail carriers, a mailbox with a lockable access door has limited utility. For example, a paper carrier could not place a newspaper into the mailbox. Alternatively, a neighbor or acquaintance, who wanted to leave a package for someone who was not presently home, could not access the locked mailbox. This has significant disadvantages in rural communities where it is impracticable for a newspaper carrier to deliver the paper to the front door of each residence. Thus, newspapers are typically kept in separate containers, where they can be easily and anonymously stolen. In addition, if a homeowner forgets to stop their mail or newspaper, for example, in anticipation of an extended trip, the accumulation of mail and newspapers is a tip off for thieves that the home is not currently occupied. Current mailboxes, however, do not prevent someone from looking in and observing the contents inside and do not have the capacity to store large accumulations of mail.

To solve the problems mentioned above, several security mailboxes have been developed that allow mail insertion without a key and also prevent unauthorized removal of the inserted mail. For example, U.S. Pat. No. 5,096,115 to Hassan and U.S. Pat. No. 5,071,063 to Overstreet illustrate mailboxes with separate incoming and outgoing mail slots. Hassan illustrates a three section structure whereby mail is inserted into a mail receiving end and passed through an intermediate body portion into a mail storage end. The structure, uses a separate outgoing mail slot for storing letters to be picked up by a mail carrier. The separate outgoing mail slot requires an additional shelf inside the main access cavity which limits the available space for storing and accepting incoming and outgoing mail. Since two slots are required, the size of each slot must be reduced. The outgoing slot is, therefore, reduced to the point where it cannot hold packages. In addition, the access area for incoming mail is also reduced which limits the size of packages that are insertable into the mailbox.

To provide a sufficient area for both incoming and outgoing mail, a larger overall structure must be provided, such as shown in U.S. Pat. No. 4,844,332 to Long. Manufacturing costs for this type of structure, however, are high because of the additional size and the need for additional structural components. Other security mailboxes, such as shown in U.S. Pat. No. 5,000,378 to Dorr et al., have no means for storing outgoing mail. This type of mailbox, therefore, has limited usefulness in residential applications where mail is only picked up if placed in the homeowner's mailbox.

Many security mailboxes use special mechanical apparatus for preventing unauthorized access. For example, U.S. Pat. No. 3,880,334 to Earle uses a rotating doorstop to prevent access to a lower receptacle. This mechanism, however, does not allow storage of outgoing mail, and in addition, requires movable parts that must be operated each time mail is inserted. These mechanical parts increase manufacturing costs and also are susceptible to mechanical failure. Therefore, the structure must be continuously maintained, for example, to prevent rust. U.S. Pat. No. 4,724,999 to Fitzgerald et al., and U.S. Pat. No. 4,993,626 to Berry also show security mailboxes that have moving parts which are activated each time mail is inserted. Additional structural components are also used, in addition to the basic mailbox structure used for storing outgoing mail and receiving incoming mail.

Accordingly, a need exists for a low cost easily manufacturable security mailbox that can receive incoming mail and hold outgoing mail without requiring special mechanical or structural components.

SUMMARY OF THE INVENTION

It is, therefore, an object of the invention to increase the effectiveness of a unitary mailbox structure in preventing unauthorized access to deposited mail while simultaneously allowing easy insertion and storage for a wide variety of incoming and outgoing packages.

Another object of the invention is to minimize the manufacturing and maintenance costs of a security mailbox.

A further object of the invention is to increase the structural stability of a standalone residential mailbox while increasing storage capacity for mail, newspapers and other delivered items.

The invention comprises a mail access section for receiving and storing mail for delivery and pickup. The access section has a front part including a front opening and a substantially horizontal bottom shelf, and a rear part having an open bottom end. The access section is sufficiently sized for receiving and supporting letters, packages, and the like for pickup and delivery by a mail carrier. A containment section is fixed below the access section and has an open top end in direct communication with the access section through the open bottom of the rear part of the access section. The containment section supports the access section above the ground and receives and stores mail that is inserted through the access section. In conjunction, the length of the access and containment sections are sufficiently sized so that mail placed into the containment section cannot be extracted through the front opening of the access section.

The length of the access section is long enough so that an intruder cannot reach through the access section down into the mail containment section. However, the access section is appropriately sized so that mail can be easily placed or tossed into the containment section. It is important to note that the same access section is used for both receiving incoming mail and holding outgoing mail and that separate storage sections are not required. This means that newspapers and large packages can be easily inserted into the containment section for extraction by the mailbox owner, or held in the access section for pickup by a mail carrier. The dual purpose access section does not require movable mechanical parts, thereby, reducing manufacturing and maintenance costs.

A lockable door is connected to the back of the containment section so that mail inserted through the containment section can be easily extracted by the authorized owner. The containment section also includes a support portion that extends into the ground to support the entire mailbox structure. The support portion prevents the structure from being tipped over and can also be used as additional storage for holding mail and newspapers. Alternatively, a support post can be attached to the access section to increase mailbox stability. A door is connected to the front of the access section and is sized to cover the front opening, thereby, protecting stored mail from the environment. In an alternative embodiment of the invention, a slidable table is located inside the access section. The table, in a closed position, covers the bottom opening of the rear part of the access section. The table allows the structure to operate as a non-security mailbox and provides a platform for holding additional outgoing mail.

In another embodiment of the invention, a multi-user security mailbox is used for multiple residences. The multi-user mailbox has multiple access sections each having a front and rear part. Multiple containment sections are affixed underneath the rear part of associated access sections. Each containment section is again sized to receive a wide variety of packages and other assorted mail in a manner similar to the single user mailbox described above. In conjunction, the length of the vertical and horizontal sections are such that mail placed in any one of the containment sections cannot be extracted through the front opening of the associated access section. A locking door is attached to the back of each containment section and is used by the mailbox owner to remove previously inserted mail.

The foregoing and other objects, features and advantages of the invention will become more readily apparent from the following detailed description of a preferred embodiment of the invention which proceeds with reference to the accompanying drawings.

DETAILED DESCRIPTION OF THE PREFERRED EMBODIMENT

Figure 1:
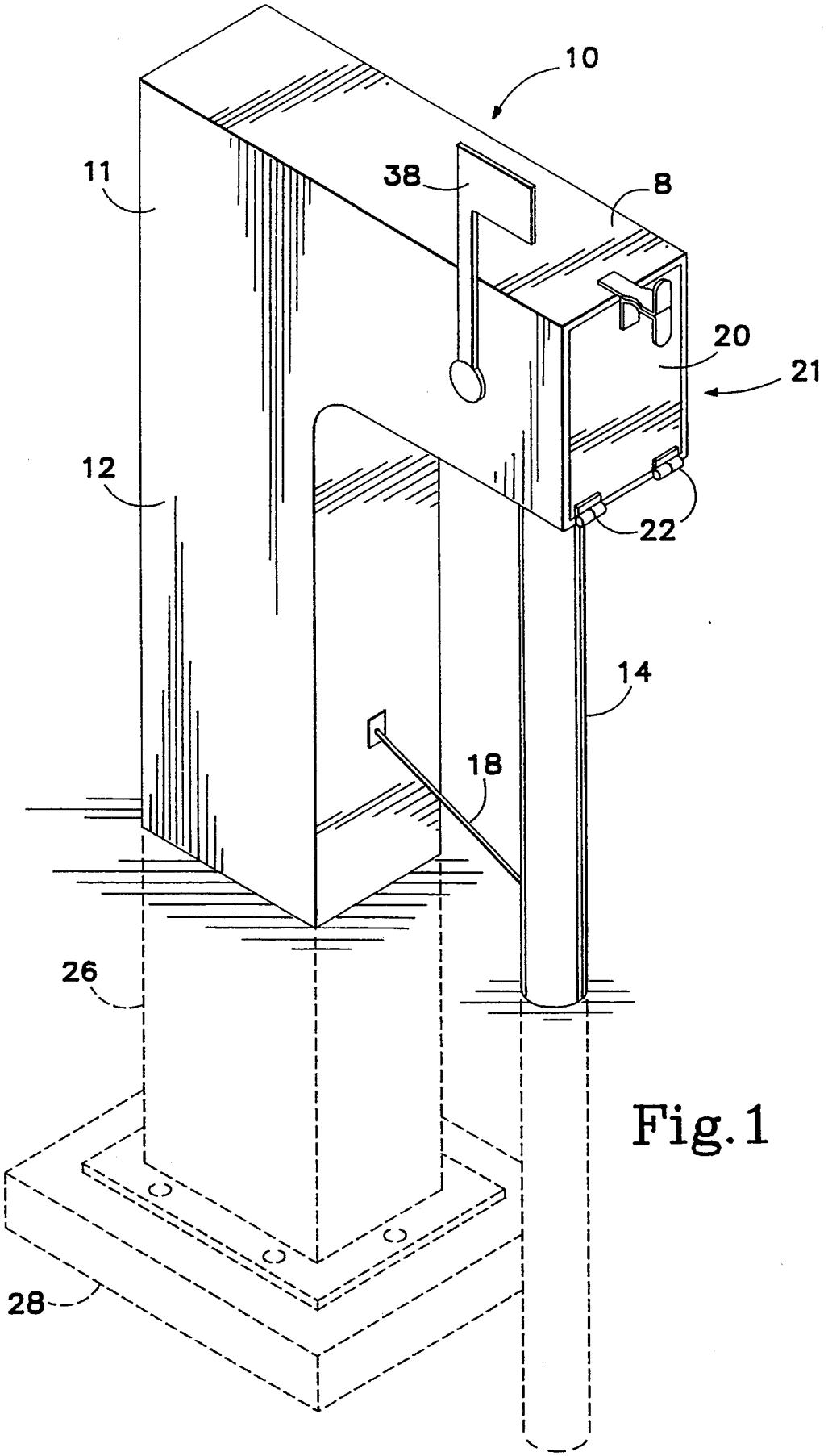
FIG. 1 is a perspective view showing a security mailbox according to a first embodiment of the invention with a subterranean portion shown in phantom.

FIG. 1 is a perspective view illustrating a security mailbox according to a first embodiment of the invention. An access section 10 is elongated in a horizontal direction and is integrally formed of a sturdy, rigid material such as steel to a containment section 12. The access section 10 includes a front part 8 having an opening 21 for inserting and extracting mail and a rear part 11 fixed to the top of containment section 12. An access door 20 is connected by hinges 22 to the front opening 21 of access section 10. A support pole 14 has a top end coupled to the bottom of access section 10 and a bottom end inserted into the ground to support the mailbox. A wire 18 is alternatively connected between the containment section 12 and the support pole 14. The containment section 12 includes a support section 26 (shown in phantom) that extends into the ground and is fixed at the bottom to a concrete pad 28. A standard mail status flag 38 is pivotally connected to the side of the access section 10.

Figure 2:
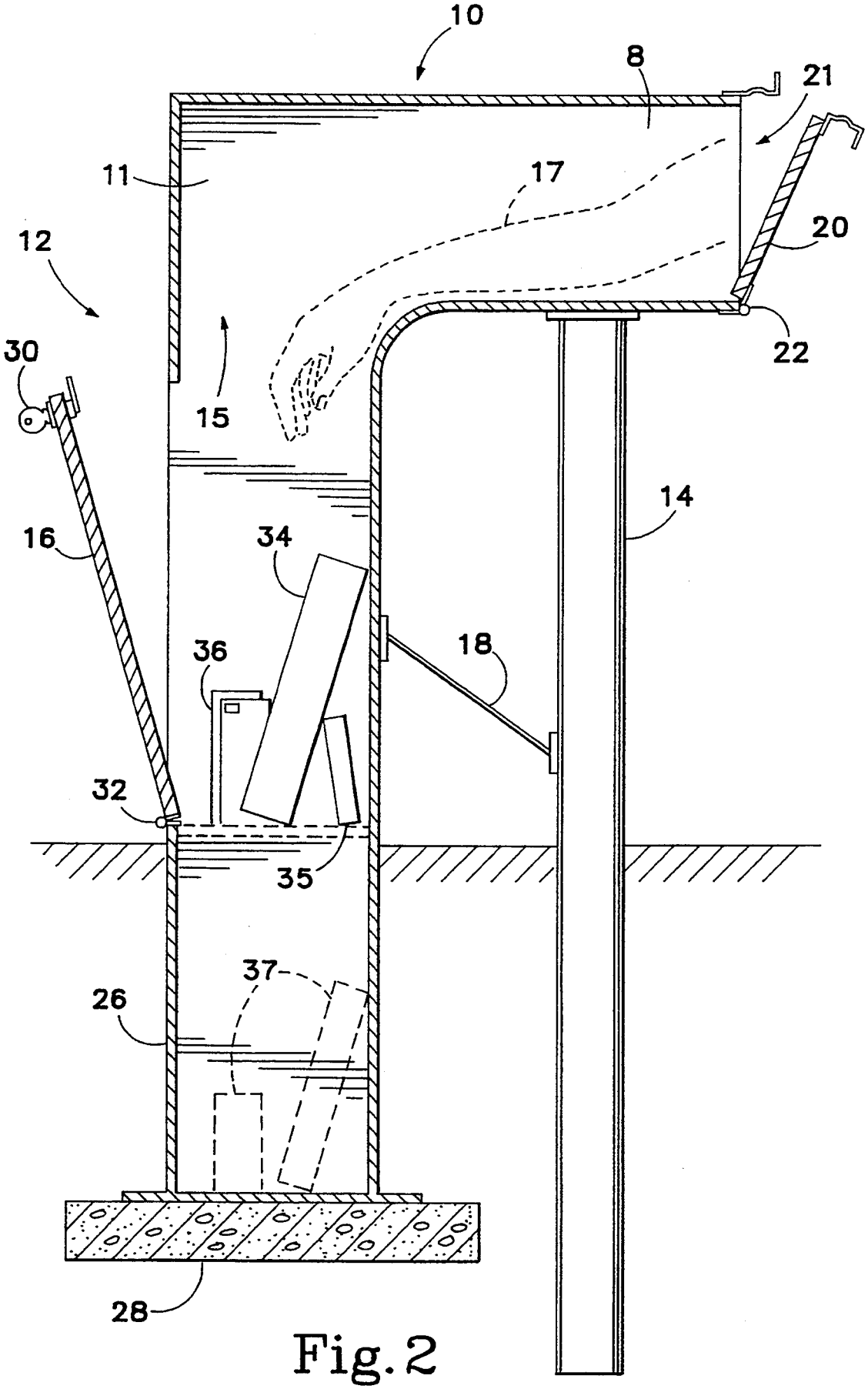
FIG. 2 is a cross-sectional view of the security mailbox shown in FIG. 1.

FIG. 2 is a cross-sectional view of the security mailbox shown in FIG. 1. The access section 10 is integrally attached to the containment section 12. The front part 8 of the access section 10 has a substantially horizontal floor defining a shelf 40 for storing and receiving mail. The rear part 11 of the access section 10 is in open communication with the front part 8 and has an open bottom end 15. The containment section 12 has an open top end in direct communication with the access section 10 through the open bottom of the rear part 11 of the access section 10. The support portion 26 of containment section 12 extends a certain length into the ground depending upon desired mailbox stability. For example, to further prevent against vandalous attempts to tip the mailbox structure over, the length of support portion 26 can be increased. For further mailbox stability, the concrete pad 28 is attached to the bottom of the support portion 26. In addition, the support post 14 can be attached to the mailbox. Alternatively, containment section 12 remains above the ground and support pole 14 is used to stabilize the mailbox. A rear lockable door 16 is coupled by hinges 32 to the back of the containment section 12 and is secured in the closed position by a lock 30.

The access section 10 provides a single access for both the insertion of mail into the containment section 12 and the storage of outgoing mail. To secure mail in the mailbox, for example, when a mail carrier delivers mail, the front door 20 is pulled away from the front part 8 of access section 10 and rotated downward. Mail 36 or newspapers 34 are then inserted through access section 10 and dropped through the bottom opening 15 of rear part 11 into containment section 12. The length of access section 10 is short enough that mail can be easily dropped or tossed over shelf 40 into the containment section 12.

The length of access section 10 in combination with the length of containment section 12, however, prevent someone from inserting their arm through opening 21 through the access section 10 down into the containment section 12. For example, adult human arm 17, as shown in FIG. 2, is not long enough to reach the newspaper 34 or mail 36. However, arm 17 is long enough to drop mail and newspapers into containment section 12. The access section, as shown in FIG. 2, therefore, has a length sufficient to prevent the adult arm 17 from extending significantly down into containment section 12. The length of access section 10 and containment section 12 are proportionately varied for alternative mailbox configurations. For example, if the length of access section 10 is shortened, the length of containment section 12 is increased to maintain restricted access to containment section 12.

The diameter of containment section 12 is also variable to provide additional space for varying amounts of mail. For example, if mail cannot be removed for extended periods of time, the width of containment section 12 is increased to increase storage capacity. Thus, containment section 12 is sized to be large enough to hold newspapers, mail, and the like that accumulate over several days. It is also possible to use support portion 26 for additional storage of incoming mail. For example, by removing the bottom of containment section 12 as shown by dashed line 35, mail 34 dropped into the containment section 12 will fall down into support section 26 as shown by dashed line 37. Thus, support section 26 can be used for additional mail storage. To remove items from containment section 12, rear door 16 is unlocked and rotated downward. The mail residing in containment section 12 is then removed and door 16 is rotated back into an upright closed position and locked to containment section 12.

Outgoing mail is placed in access section 10 on shelf 40. It should be noted that access section 10 is used for both inserting incoming mail and storing outgoing mail for pickup by a mail carrier. As stated above, this allows larger packages to be inserted through and stored in access section 10. The shelf 40 is also of sufficient length to support a large number of packages inserted far into the access section that are to be picked up by a mail carrier. It is also noted that the security mailbox does not require moving parts or special structural components to prevent unauthorized access. This further minimizes manufacturing and maintenance costs.

Figure 3:
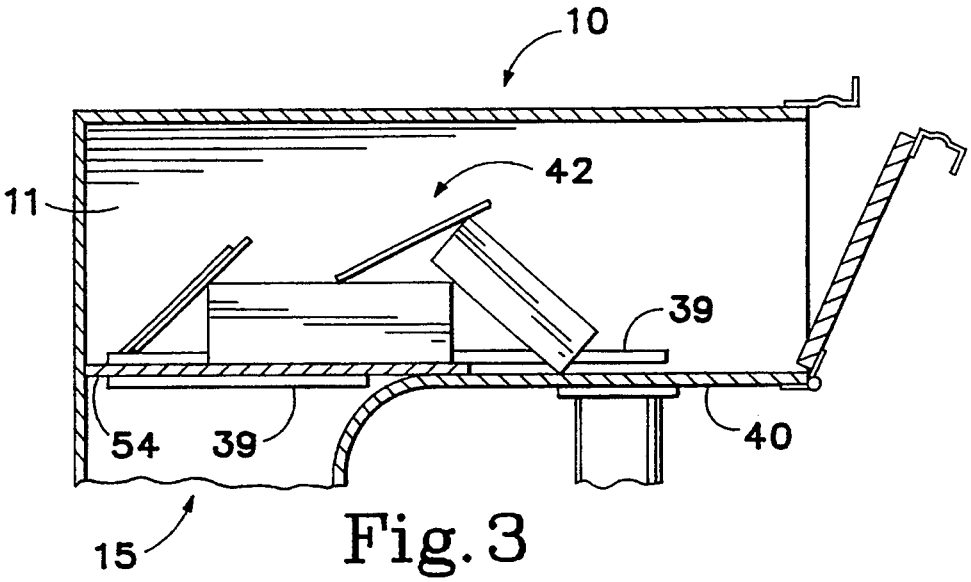
FIG. 3 is a partial cross-sectional view showing a slidable table in a closed position that can be alternatively attached inside the security mailbox shown in FIG. 1.
Figure 4:
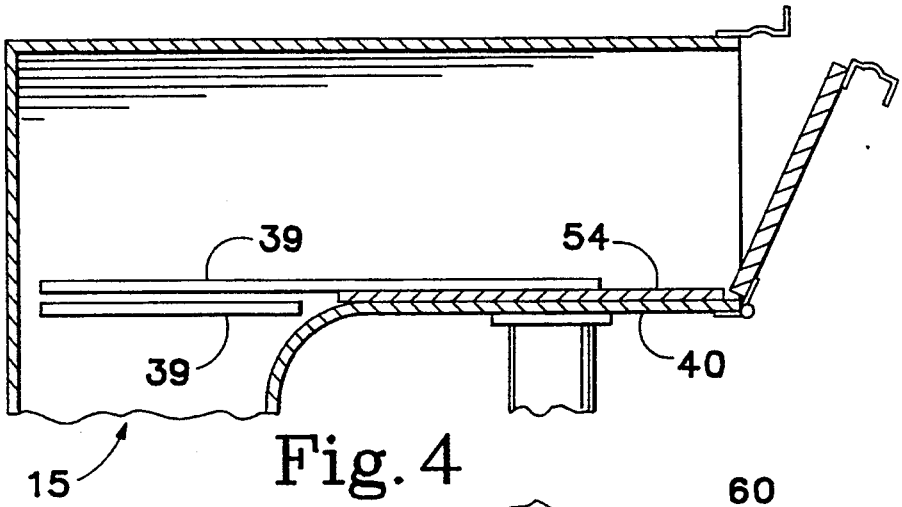
FIG. 4 is a partial cross-sectional view showing the slidable table of FIG. 3 in an open position.

FIG. 3 is a partial cross-sectional view showing a slidable table in a closed position and FIG. 4 is a partial cross-sectional view showing the slidable table in an open position. A table 54, in an alternative embodiment of the invention, is attached inside access section 10 and is inserted between runners 39. The table is dimensioned to cover the bottom opening 15 of the rear part 11 of access section 10.

In the closed position, shown in FIG. 3, table 54 increases the available space in access section 10 for storing outgoing mail, such as mail 42. For example, without table 54, the maximum available storage space for outgoing mail is defined by shelf 40 (see FIG. 2) and stops at the edge of opening 15. However, when table 54 is attached and moved into a closed position, the effective area of shelf 40 is extended over opening 15. Thus, the space previously taken up by opening 15 can now be used to store additional mail. This allows the structure to operate as a standard non-security mailbox. To re-enable the security mailbox, table 54 is moved into the open position shown in FIG. 4. In the open position, table 54 is moved onto shelf 40 and opening 15 is no longer obstructed. Mail can then again be inserted through access section 10 into containment section 12. Thus, table 54 enables the structure to operate as either a normal non-security mailbox or as a storage and security mailbox.

Figure 5:
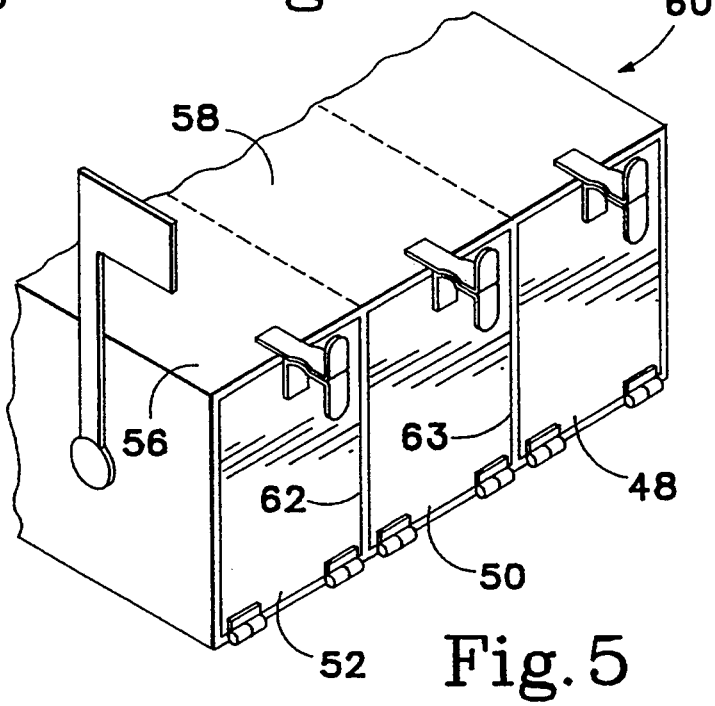
FIG. 5 is a partial perspective view of a multi-user security mailbox according to a second embodiment of the invention.

FIG. 5 is a perspective view showing a multi-user security mailbox according to a second embodiment of the invention. Multiple access sections 56, 58, and 60, are separated by partitions 62 and 63. Multiple containment sections (not shown) are affixed to associated access sections similar to those shown in FIG. 1. Each access section and associated containment section operates as a separate security mailbox in a manner similar to that previously described in FIG. 1. Each mailbox has an associated rear locking door (not shown) for removal of mail from its associated containment section. The partitions 62 and 63 prevent the owner of one mailbox from accessing mail inserted into an adjacent mailbox. Separate doors 48, 50, and 52 are attached to access sections 60, 58, and 56, respectively, and protect stored mail from the environment.

The multi-user security mailbox operates in a manner similar to the security mailbox shown in FIG. 1. This embodiment, however, provides further cost reductions for multiple residences that have mailboxes which can be placed in approximately the same location. For example, only one support hole and one concrete pad have to be inserted into the ground for the multi-user mailbox. In addition, the overall stability of the multi-user mailbox is increased since a larger structure is inserted and anchored into the ground. Alternatively, the table 54, previously illustrated in FIGS. 3 and 4, can be attached inside any or all of the access sections 56, 58, or 60. Since each cavity provides access for both incoming mail, newspapers, and storage for outgoing mail, the size of the overall structure is reduced and accordingly the manufacturing costs minimized.

The security mailbox is manufactured out of a variety of different materials depending on cost constraints and the amount of desired security. For example, a low cost version can be manufactured out of a single unitary piece of plastic. However, for additional stability, a metal or wood structure is used. Therefore, by utilizing the physical dimensions of the mailbox, unauthorized access to mail is prevented without having to resort to additional mechanical apparatus. The result is a low cost security mailbox that is effective in storing and protecting mail and other deliverable items.

Having described and illustrated the principles of the invention in a preferred embodiment thereof, it should be apparent that the invention can be modified in arrangement and detail without departing from such principles.

I claim all modifications and variation coming within the spirit and scope of the following claims.

1. A security mailbox comprising:

an access section elongated in a horizontal direction, the access section including a front part having an opening for inserting and extracting mail and having a substantially horizontal stationary floor rigidly joined at a bottom end and sized to be at least one half the length of the access section defining a shelf for storing and receiving mail, the access section further including a horizontally aligned rear part having an open bottom end; and a containment section elongated in a vertical direction having an open top end in direct communication with the access section through the open bottom of the rear part of the access section, the containment section fixed below the access section for receiving mail through the open bottom end of the access section;

the length of the floor preventing the arm from extending down into the containment section to prevent removal of mail from the containment section through the access section.

2. The mailbox according to claim 1 wherein the rear part of the access section if in open communication with the front part of the access section, the front part having a rearward edge forming a periphery of the open bottom of the rear part of the access section so that a parcel resting on the shelf of the access section can slide over the rearward edge of the shelf and fall through the open bottom of said rear part of the access section into the containment section for storage.

3. The mailbox according to claim 1 including a lockable door connected to the containment section for extracting mail deposited therein.

4. The mailbox according to claim 1 including a support post having a top and bottom end, the top end coupled to the bottom of the access section and the bottom end inserted into the ground for increasing mailbox stability.

5. The mailbox according to claim 1 including a door connected to the access section and sufficiently sized to cover the front opening for inserting mail contained within the mailbox from the environment.

6. The mailbox according to claim 1 wherein the access and containment sections are manufactured in a single unitary body.

7. A mailbox comprising:

an access section elongated in a horizontal direction, the access section including a front part having an opening for inserting and extracting mail and having a substantially horizontal stationary floor rigidly joined at a bottom end defining a shelf for storing and receiving mail, the access section further including a rear part having an open bottom end;

a containment section elongated in a vertical direction having an open top end in direct communication with the access section through the open bottom of the rear part of the access section, the containment section fixed below the access section for receiving mail through the open bottom end of the access section;

the access section and the containment section in combination sized to prevent removal of mail from the containment section through the access section; and wherein the containment section includes a support section having a hollow cavity substantially the same size as the open top of the containment section and extending into the ground, the support section sized to support the mailbox upright.

8. The mailbox according to claim 7 wherein the support section is in direct communication with the mail containment section and can be used for additional mail storage.

9. The mailbox according to claim 7 including a concrete pad coupled to the bottom of the support section for further increasing the stability of the mailbox.

10. A mailbox comprising:

an access section elongated in a horizontal direction, the access section including a front part having an opening for inserting and extracting mail and having a substantially horizontal stationary floor rigidly joined at a bottom end defining a shelf for storing and receiving mail, the access section further including a rear part having an open bottom end;

a containment section elongated in a vertical direction having an open top end in direct communication with the access section through the open bottom of the rear part of the access section, the containment section fixed below the access section for receiving mail through the open bottom end of the access section;

the access section and the containment section in combination sized to prevent removal of mail from the containment section through the access section; and a slidable table located within the access section, the table slidable in a horizontal direction along a top surface of the shelf, the table sufficiently dimensioned so that the bottom opening of the rear part of said access section remains uncovered when the table is in an open position and is covered when the table is in a closed position.

11. The mailbox according to claim 10 wherein the table is supported horizontally on the shelf in a open position and is supported horizontally over the bottom end of the access section in the closed position by a set of runners located on opposite sides of the containment section.

12. A security mailbox comprising:

multiple access sections elongated in a horizontal direction, each access section including a front part having an opening for inserting and extracting mail and a substantially horizontal floor sized to be at least half the length of the access section defining a shelf for storing and receiving mail, each access section further including a horizontal rear part having an open bottom end; and multiple vertical elongated containment sections having an open top end fixed below and in direct communication with the open bottom of the rear part of an associated access section for receiving mail through the access section;

the length of the floor of each access section preventing an arm from extending from the front opening down into the containment section thereby preventing removal of mail from said containment section through said access section, adjacent access sections and the associated adjacent containment sections each utilizing a common side wall.

13. The mailbox of claim 12 including multiple locking doors, each door coupled to an associated containment section for extracting mail within said containment section.

14. The mailbox of claim 12 including multiple front access doors, each connected to the front opening of an associated access section and sufficiently sized to cover the front opening of said access sections.

15. A method for preventing unauthorized removal of mail from a mailbox comprising:

providing a mailbox with an access section elongated in a horizontal direction including a horizontally aligned rigidly attached bottom floor, the access section further including a horizontally aligned rear part having an open bottom end, and a mail containment section elongated in a vertical direction and joined at a back end of the access section;

inserting mail into the containment section through the access section;

storing the access section above the ground with the containment section; and selecting the length of the access section floor to be at least half the length of the access section thereby preventing items placed in said containment section from being removed through said access section.

16. A method for preventing unauthorized removal of mail from a mailbox comprising:

providing a mailbox with an access section elongated in a horizontal direction including a horizontally aligned rigidly attached bottom floor and a mail containment section elongated in a vertical direction and joined at a back end of the access section;

inserting mail into the containment section through the access section;

storing mail in the access section for pickup by a mail carrier;

supporting the access section above the ground with the containment section;

selecting the length of the containment and access sections so that items placed in said containment section cannot be removed through said access section;

providing a table;

sliding the table horizontally along the access section floor so that in a first position substantially the entire table rests on top of the floor; and sliding the table horizontally along the floor toward the back of the access section thereby obstructing access to the containment section and expanding usable horizontal floor space on the bottom of the access section thereby increasing the amount of mail that can be stored in the access section.

17. A security mailbox comprising:

an access section elongated in a horizontal direction having side walls joined together at a top end by a top wall and rigidly joined together at a bottom end by a horizontally aligned bottom wall forming a horizontally directed cavity, the side walls and top wall joined together at a back end by a back wall forming a rear opening in the rear end of the access section between the bottom wall and the back wall;

a containment section in direct communication with the access section having a front vertically aligned containment wall joined at a back end of the access section bottom wall and a back vertically aligned containment wall joined underneath the access section back wall, the front and back containment walls extending from the access section to a ground surface and joined by side containment walls forming a vertically directed containment cavity aligned directly underneath the rear opening in the access section thereby maintaining a constant cross-sectional shape throughout the entire containment section that is substantially the same size as said rear opening; and a table aligned horizontally in the access section, the table in a first position resting substantially on the bottom wall of the access section and slidable horizontally along the bottom wall into a second position at the back of the access section thereby covering the access section rear opening.

18. A security mailbox comprising:

an access section elongated in a horizontal direction having side walls joined together at a top end by a top wall and rigidly joined together at a bottom end by a horizontally aligned bottom wall forming a horizontally directed cavity, wherein the length of the bottom wall of the access section is at least half the length of the access section cavity, the side walls and top wall joined together at a back end by a back wall forming a rear opening in the rear end of the access section between the bottom wall and the back wall; and a containment section in direct communication with the access section having a front vertically aligned containment wall joined at a back end of the access section bottom wall and a back vertically aligned containment wall joined underneath the access section back wall, the front and back containment walls extending from the access section to a ground surface and joined by side containment walls forming a vertically directed containment cavity aligned directly underneath the rear opening in the access section thereby maintaining a constant cross-sectional shape throughout the entire containment section that is substantially the same size as said rear opening.

* * * * *